US005251881A

United States Patent [19]

Reiniche

[11] Patent Number: 5,251,881

[45] Date of Patent: Oct. 12, 1993

[54] METHODS AND DEVICES FOR THE THERMAL TREATMENT OF METAL WIRES UPON PASSING THEM OVER CAPSTANS

[75] Inventor: Andre Reiniche, Clermont-Ferrand, France

[73] Assignee: Compagnie Generale des Etablissements Michelin - Michelin & Cie, Clermont-Ferrand, France

[21] Appl. No.: 838,418

[22] PCT Filed: Sep. 7, 1990

[86] PCT No.: PCT/FR90/00592

§ 371 Date: Mar. 9, 1992

§ 102(e) Date: Mar. 9, 1992

[87] PCT Pub. No.: WO91/04345

PCT Pub. Date: Apr. 4, 1991

[51] Int. Cl.[5] ..... C21D 5/96

[52] U.S. Cl. ..... 266/109; 266/103

[58] Field of Search ..... 266/103, 109, 110, 102, 266/108; 242/47.01, 47.08

[56] References Cited

U.S. PATENT DOCUMENTS

| | | | |
|---|---|---|---|
| 2,965,368 | 12/1960 | McIlvried | 266/103 |
| 3,021,128 | 2/1962 | Jonason | 266/103 |
| 4,012,028 | 3/1977 | Dunaevsky et al. | 266/103 |
| 4,062,528 | 12/1977 | Olivero | 266/103 |
| 4,919,395 | 4/1990 | Ritter et al. | 266/103 |

FOREIGN PATENT DOCUMENTS

| | | |
|---|---|---|
| 0034829 | 1/1964 | Fed. Rep. of Germany . |
| 57-99760 | 12/1983 | Japan . |
| 61-24976 | 8/1987 | Japan . |
| 1224347 | 4/1986 | U.S.S.R. . |

*Primary Examiner*—Scott Kastler

*Attorney, Agent, or Firm*—Brumbaugh, Graves, Donohue & Raymond

[57] ABSTRACT

Process and device (1) for the heat treatment of at least one metal wire (4) using capstans (2, 3) characterized by the following features: (a) the wire (4) is brought around at least two capstans (2, 3) which conduct the heat and which include recesses (11). The wire (4) is reeved and crossed in said recesses (11), the width of the recesses (11) being slightly greater than that of the wire (4); (b) the capstans (2, 3) are heated or cooled by means of at least one gas (27), which passes between the capstans and a part which is in contact with a heat exchanging fluid; (c) the thickness of the gas layer is chosen according to the heat treatment to be applied. Installations for the heat treatment of metal wires (4) include at least one device (1), metal wires (4) treated by the process and/or the device (1), and/or the installations according to the invention, as well as items reinforced by said wires (4), in particular tire treads.

22 Claims, 7 Drawing Sheets

METHODS AND DEVICES FOR THE THERMAL TREATMENT OF METAL WIRES UPON PASSING THEM OVER CAPSTANS

BACKGROUND OF THE INVENTION

The present invention relates to methods and devices for thermally treating metal wires. Such methods and devices permit, for instance, the perlitization of steel wires so as to obtain a fine perlitic structure at a high speed, for instance at least equal to 15 m/second.

From SU Patent A-1 224 347, it is known to effect a perlitization treatment by passing a steel wire over smooth capstans placed in the ambient air so as to effect this treatment at a substantially higher speed than in a conventional lead patenting installation and without having the drawbacks of said lead technique which reside, in particular, in the dangers to health and the protection of the environment. Experience shows that the method described in that patent leads to the obtaining of products having a definitely poorer value in use than that which can be obtained with lead patenting. As a matter of fact, the cooling curve contains a substantial area of recalescence, for example a rise in temperature of 50° C. for wires having a diameter of 3 mm. This substantial recalescence is due to the poor heat transfer coefficient between the wire and the capstan, which leads to a large difference in temperature between the wire and the capstan when the thermal power peak caused by the transformation of austenite into perlite takes place. Now, the presence of recalescence above 20° C. during the heat treatment does not make it possible to obtain a high value in use of the wires, particularly when they are of large diameters.

European Patent Application A-275 864 describes a method for the heat treatment of metal wires by passing them over disks having grooves within an enclosure in which a protective gas is contained, the heating of the wires being obtained directly by irradiation.

U.S. Pat. No. 2,965,368 describes a method for the heat treatment of metal wires by passing them through grooves of capstans which are heated on the inside, the wires being reeved crosswise on these capstans in contact with a protective gas.

SUMMARY OF THE INVENTION

The object of the invention is to propose a method and an apparatus which permit the thermal treatment of a metal wire by passing the wire over capstans so as simultaneously to have a high speed of passage of the wire and a good thermal exchange between the wire and the capstan.

Accordingly, the invention relates to a method which permits the thermal treatment of at least one metal wire by means of capstans, in which the wire is passed over at least two heat-conducting capstans having grooves, the wire being reeved, crossed in these grooves, the width of the grooves being slightly greater than that of the wire, a gas in the grooves being in contact with the wire and the capstans; this method being characterized by the following features:

(a) the capstans are heated or cooled by means of the gas, which is also arranged between the capstans and at least one part, this gas being in contact with the capstans and the part, said heat-conducting part being located outside the capstans, by circulating a heat-exchange fluid other than the gas in contact with the part so that heat exchanges take place, on the one hand, between the gas and the part and, on the other hand, between the part and the fluid;

(b) the thickness of the layer of gas between the capstans and the part is adjusted as a function of the thermal treatment to be carried out.

The invention also relates to a device which permits the thermal treatment of at least one metal wire by means of capstans, the device having at least two heat-conductive capstans with grooves, the device furthermore having means which make it possible to pass the wire in the grooves of the capstans, the wire being reeved, crossed in these grooves, the width of the grooves being slightly greater than that of the wire, and a gas, within the grooves, in contact with the wire and the capstans; the device being characterized by the following features:

(a) it comprises means permitting the heating or cooling of the capstans, these means comprising:
- at least one heat-conductive part located on the outside of the capstans;
- means which permit causing a heat-exchange fluid other than the gas to flow in contact with the part;
- the gas, also arranged between the capstans and the part, in contact with the capstans and the part;
- these means being arranged so that heat exchanges take place, on the one hand, between the gas and the part and, on the other hand, between the part and the fluid;

(b) it comprises means making it possible to regulate the thickness of the layer of gas between the capstans and the part as a function of the thermal treatment to be carried out.

The invention also relates to installations for the thermal treatment of metal wires comprising at least one device in accordance with the invention.

The invention also relates to metal wires treated by the method and/or the device and/or the installations in accordance with the invention, as well as the articles reinforced by these wires, such articles being, for instance, articles of rubber and/or of plastic, in particular belts, hoses and tires.

The invention will be easily understood from the non-limitative examples which follow and the diagrammatic figures relating to these examples.

DESCRIPTION OF PREFERRED EMBODIMENTS

Figure 1:
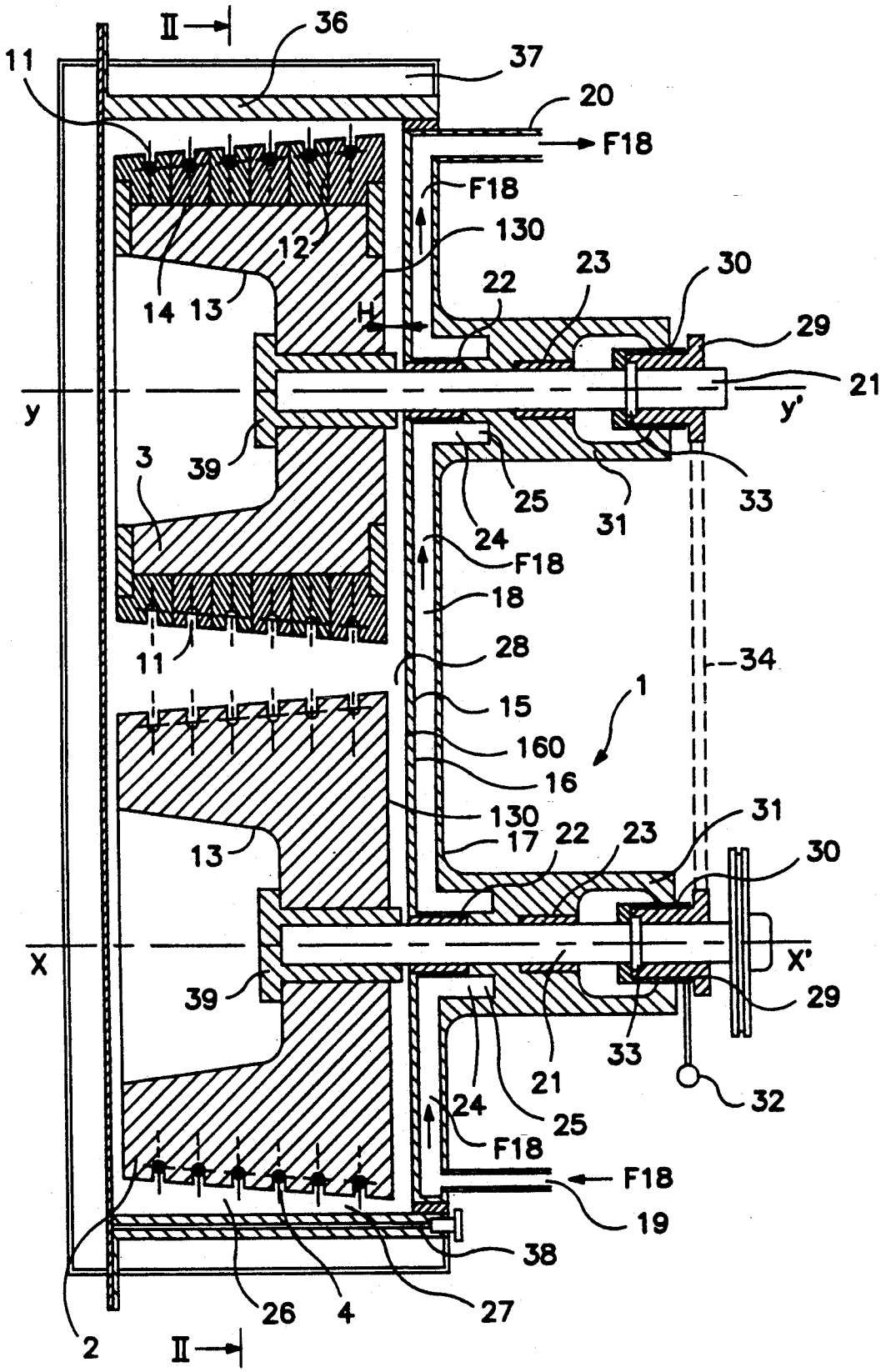
FIG. 1 shows, in section, a device in accordance with the invention having two capstans with grooves, this section being diagrammatically indicated by the line segments I—I in FIG. 2.
Figure 2:
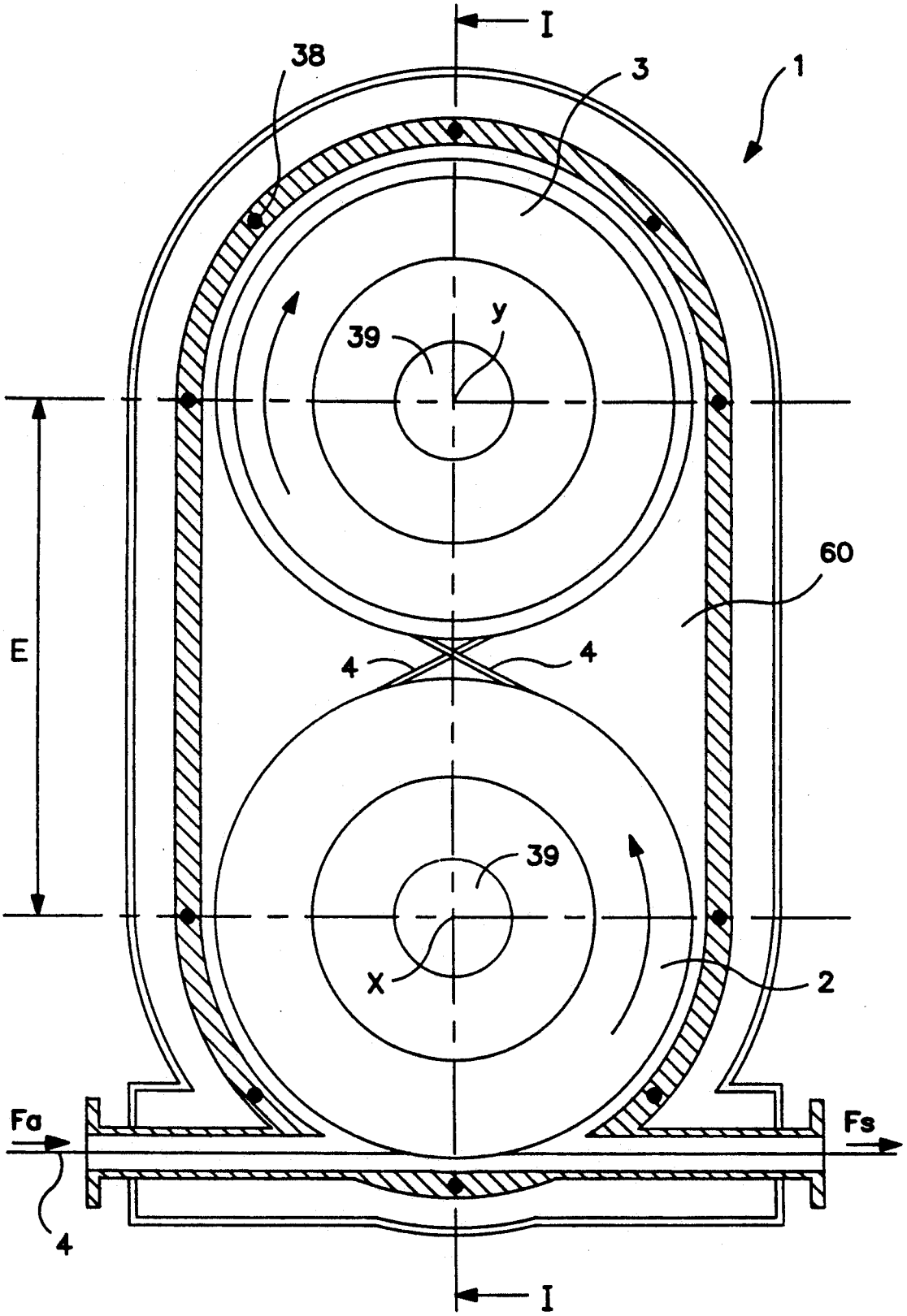
FIG. 2 shows, in a different section, the device according to the invention which was shown in FIG. 1, the section of FIG. 2 being diagrammatically indicated by the line segments II—II in FIG. 1.
Figure 3:
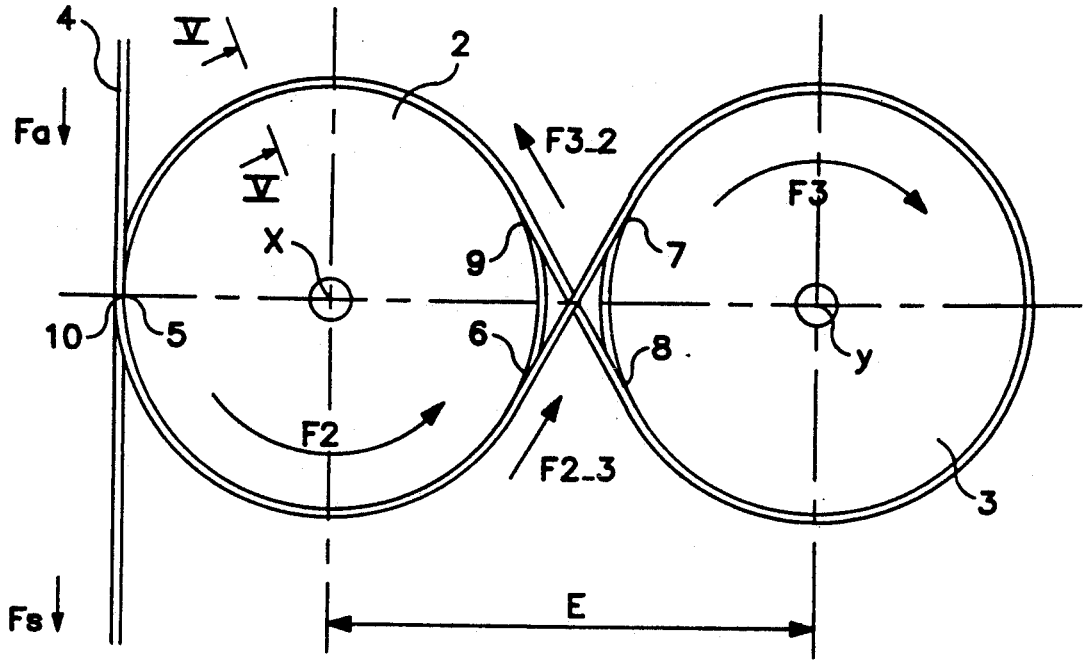
FIG. 3 is a front view of the two capstans of the device of the invention shown in FIGS. 1 and 2, with the wire reeved on these capstans, the other parts of the device being assumed removed.
Figure 4:
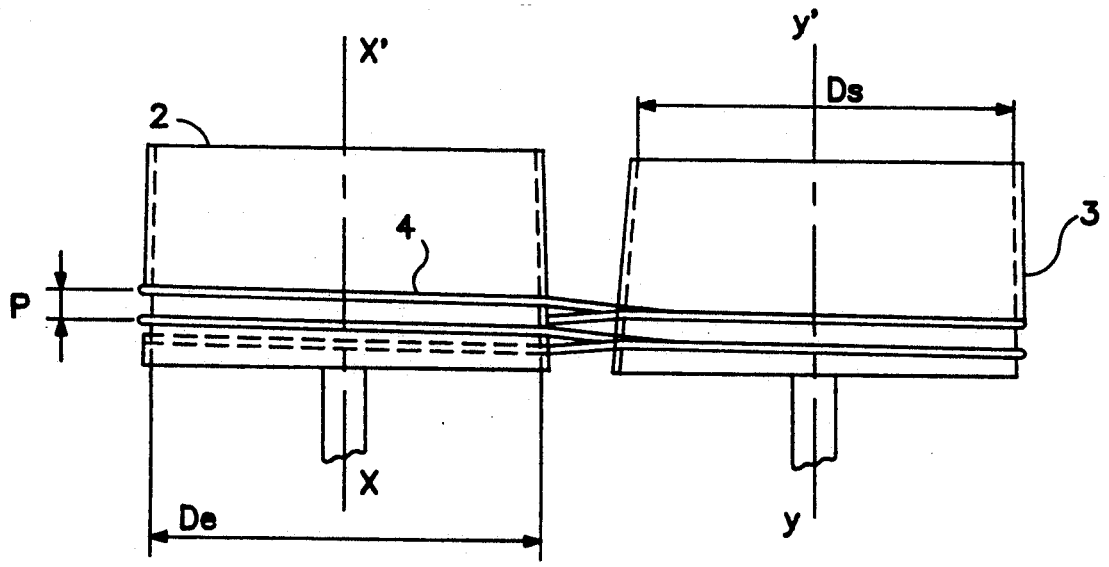
FIG. 4 is a side view of the two capstans of the device of the invention shown in FIGS. 1 and 2, with the wire reeved on these capstans, the other parts of the device being assumed removed.

FIGS. 1 and 2 show a device 1 in accordance with the invention which employs the method in accordance with the invention. This device 1 has two capstans 2, 3 on which the wire 4 to be treated is wound. The heat-conductive capstans 2, 3 are formed, for instance, of metallic material. The axis of rotation of the capstan 2 is marked xx' and the axis of the capstan 3 is marked yy'. The axes xx' and yy' are parallel to each other and located, for instance, in the same vertical plane. FIG. 1 is a section through the device 1 along the vertical plane passing through the axes xx' and yy'; FIG. 2 is a section through the device 1 along a vertical plane perpendicular to the axes xx' and yy'; FIG. 3 is a front view of the capstans 2 and 3, with the wire 4 reeved on these capstans, and FIG. 4 is a side view of these capstans 2 and 3, with the wire 4 reeved on these capstans, the other parts of the device 1 being assumed removed in FIGS. 3 and 4. The section of FIG. 1 is diagrammatically indicated by the line segments I—I in FIG. 2, and the section of FIG. 2 is diagrammatically indicated by the line segments II—II in FIG. 1. The axis xx' is marked by the letter x in FIGS. 2 and 3 and the axis yy' is marked by the letter y in FIGS. 2 and 3. The wire 4 arrives, in the direction of the arrow Fa, at the point 5 of the lower capstan 2 (FIG. 3). The capstan 2 is driven in rotation around the axis xx' by a motor, not shown in the drawing in order to simplify it, the rotation of the capstan being indicated by the arrow F2. The wire 4 is driven by the capstan 2 up to the point 6, where it leaves the capstan 2 and is moved in the direction indicated by the arrow F2-3 towards the upper capstan 3, which is not driven. At the point 7, it contacts the capstan 3 which supports it up to the point 8, the rotation of the capstan 3 around the axis yy' being indicated by the arrow F3.

The wire 4 then leaves the capstan 3 and is moved in the direction of the arrow F3-2 to the capstan 2, which it contacts at the point 9. The capstan 2 then drives the wire 4 again in its rotation in the direction of the capstan 3. The reeving of the wire 4 on the capstans 2 and 3 is crossed, that is to say the rotation F3 of the capstan 3, driven by the wire 4, is in the direction opposite the rotation F2 of the capstan 2, the directions F2-3 and F3-2 intersecting, without there being contact between the successive portions of the wire 4 between the capstans 2 and 3. This path is repeated several times, the wire 4 thus effecting several runs in the form of a figure eight over the two capstans 2 and 3. The wire 4 finally leaves the pair of capstans 2, 3 at the point 10 of the lower capstan 2, in the direction indicated by the arrow Fs (FIG. 3).

The contact of the wire 4 with the capstans 2 and takes place in grooves 11 provided in these capstans.

Figure 5:
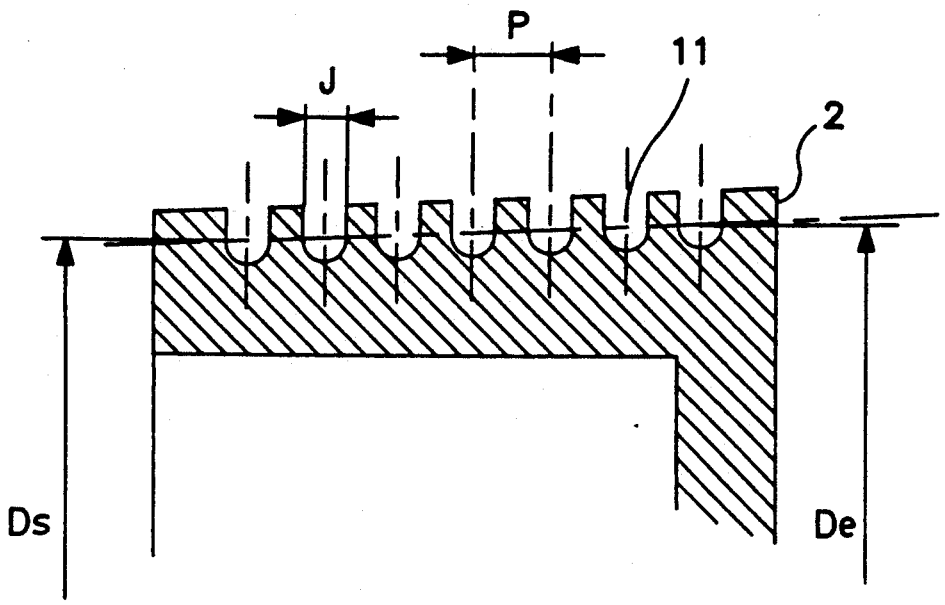
FIG. 5 is a section through a portion of one of the capstans shown in FIGS. 3 and 4, this section being diagrammatically indicated by the line segments V—V of FIG. 3.

FIG. 5 is a section through a portion of the capstan 2 along a plane passing through the axis xx' of this capstan, this section being indicated by the line segments V—V in FIG. 3.

Figure 6:
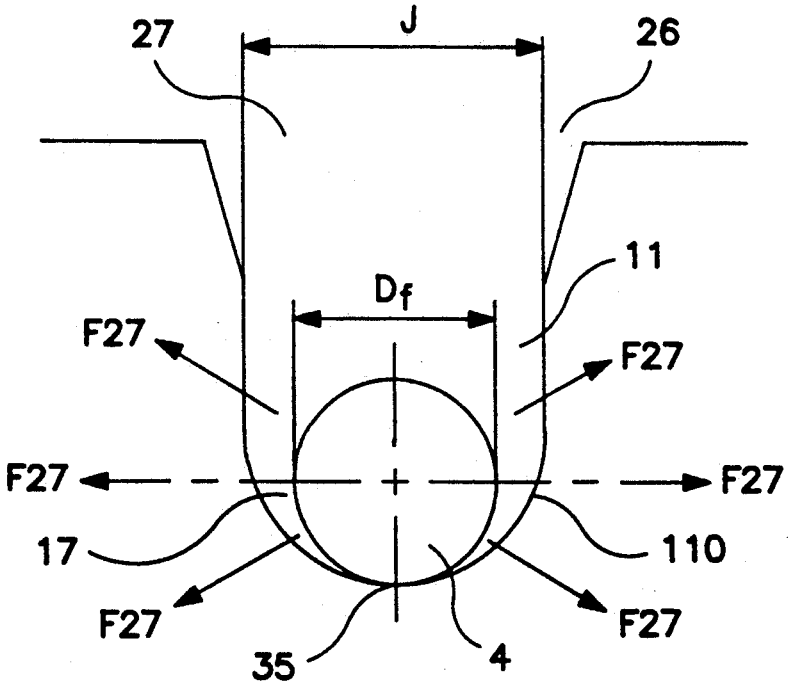
FIG. 6 shows in greater detail, in section, one of the grooves of the capstan shown in FIG. 5, the section being taken under the same conditions as in FIG. 5.

This sectional view shows grooves 11, one of which is shown enlarged in FIG. 6, with the wire 4 arranged in said groove, the section of FIG. 6 being taken along the same plane as FIG. 5. The capstan 2 has, for instance, seven grooves 11, each of these grooves having as its axis the axis xx' of the capstan 2. In the plan view of FIG. 6, the width J of the groove 11 is slightly greater than the diameter Df of the wire 4, the groove 11 having a bottom 110 with the shape of a semi-circle of diameter J in FIG. 6. All of the grooves 11 of the capstans 2 and 3 have the same shape and the same width J.

The radial clearance (J-Df)/2 and the distance p between the grooves 11 (pitch of the grooves) must be sufficiently large that the wire 4 can pass from the groove 11 of one capstan to the corresponding groove 11 of the other capstan without the wire 4 rubbing on itself at the places where the portions of the wire 4 cross between the capstans 2, 3 (FIGS. 5 and 6), which values can be selected by the person skilled in the art as a function of the use.

The grooves 11 of the non-driven capstan 3 are preferably located on rings 12 of axis yy'. These heat-conductive rings, which are made, for instance, of metallic material, are mechanically separated from the body 13 of the capstan 3 (FIG. 1). The body 13 turns freely around the axis yy' and the rings 12 can turn freely around the axis yy' independently of the body 13, these rings 12 sliding on the cylindrical surface 14 of the body 13. Furthermore, the rings 12 can turn freely with respect to each other. This arrangement makes it possible to improve the contact between the wire 4 and the capstan 3 and to improve the tension of the wire 4 between the capstans 2, 3.

The heating or cooling of the capstans 2, 3 is effected by a heat-conductive part, for instance a metal plate 15 having two walls 16, 17 between which a heat-exchange fluid 18, for instance a liquid, particularly water, flows, the wall 16 being arranged on the side of the capstans 2, 3. The means permitting the circulation of the fluid 18 between the walls 16, 17 are known means comprising, for instance, a pump, and they have not been shown in the drawing for purposes of simplification. The fluid 18 arrives through the connection 19; it circulates between the walls 16, 17 and then leaves the plate 15 through the connection 20, the flow of the fluid 18 being indicated by the arrows F18. The capstans 2, 3 are mounted on shafts 21 which turn in bearings 22, 23. The shafts 21 pass through the walls 16, 17 and are separated in an impervious manner from the fluid 18 (FIG. 1). Each of the bearings 22 is surrounded by a sleeve 24, within which a cooling fluid 25 circulates, the circulation of this fluid 25 not being shown for purposes of simplification. The fluid 25 may be the fluid 18, which is then itself a cooling fluid, the sleeve 24 communicating then with the inside of the plate 15 where the fluid 18 circulates.

The capstans 2, 3 are placed in an enclosure 26 containing a gas 27, preferably a non-oxidizing gas, for example hydrogen or a mixture of hydrogen and nitrogen. The heat exchanges between the capstans 2, 3 and the heat-exchange fluid 18 take place via the gas 27 which forms a layer 28 of thickness H, located between the substantially flat face 160 of the wall 16, on the one hand, and each substantially flat face 130 of the capstans 2, 3 on the other hand. The faces 130 are arranged substantially in one and the same plane perpendicular to the axes xx', yy' and substantially parallel to the face 160, which therefore partly defines the enclosure 26, the gas 27 being in contact with the capstans 2, 3 and the face 160. When the thermal treatment of the wire 4 is a heating, the fluid 18, if used, is a heating fluid, the heat passing from the fluid 18 to the gas 27 and then from the gas 27 to the capstans 2, 3 and finally from said capstans towards the wire 4. When the treatment of the wire 4 is a cooling treatment, the fluid 18 is a cooling fluid and the heat flows in the opposite direction, from the wire 4 to the fluid 18 The gas 27 in direct contact with the plate 15 and the capstans 2, 3 permits this heat exchange, the plate 15 being made of a heat-conductive material, for instance a metallic material. The threaded elements 29 make it possible to change the distance H by displacing the capstans 2, 3 along their respective axes xx' and yy' For this purpose, the threaded elements 29 are screwed into female threads 30 in stationary parts 31 of the device 1. The modification of the thickness H of the layer 28 of the thermal coupling gas 27 is obtained by acting on the lever 32 which drives the threaded elements 29 in rotation, this causing an axial displacement of these threaded elements 29, which axial displacement is transmitted to the shafts 21 via shoulders 33 machined on the shafts 21. The lever 32 makes it possible to simultaneously actuate the two shafts 21 of the capstans 2, 3 by known means 34, indicated diagrammatically by dotted lines in FIG. 1, these means being, for instance, a notched belt or a chain. The heat exchanges take place between the wire 4 and the capstan 2 or 3, on the one hand, by direct contact along the line of contact 35 between the wire and the capstans, on the bottom 110 of the groove 11, and, on the other hand, by passing through the gas 27 which is present in the grooves 11 in contact With the wire 4 and the capstans 2, 3, this thermal flow being diagrammatically indicated by the arrows F27 (FIG. 6) in the case of the cooling of the wire 4. Instead of using a single gas 27 for the grooves 11 and the layer 28, one could use two different gases having different thermal conductivities; however, for reasons of simplicity, it is preferable to have a single gas 27, as shown in the case of the device 1. Similarly, it would be possible to use several parts 15 in the device 1, but it is preferable to use only one for purposes of simplification.

The limiting of the radial clearance (J-Df)/2 makes it possible to facilitate the heat exchanges between the wire 4 and the capstans 2, 3.

When the thermal treatment consists in rapidly cooling a wire of large diameter, the gas 27 must be a good conductor of heat since, otherwise, the thickness H of the layer 28 of gas 27 between the plate 15 and the capstans 2, 3 could be of the same order as the expansion of the materials constituting the installation. Preferably: $1\ mm \leqq H \leqq 200\ mm$.

The gas 27 in the enclosure 26 is therefore in the layer 28, and preferably undergoes substantially no other movements than those which are due to the rotation of the capstans 2, 3.

The capstans 2, 3 are placed in an enclosure 36 which is insulated on the outside by an element 37. When the device 1 is intended to carry out a thermal treatment o a wire 4 which is already hot, the enclosure 36 is, for instance, equipped with electric heating elements 38 distributed uniformly over its perimeter. The heating elements 38, for instance resistors, then permit the heating of the capstans 2, 3 upon the starting of the device 1 and thus make it possible to obtain very rapid placings in operation. The shafts 21 are thermally protected by thermal shields 39. These elements 38 can also serve, for instance, when the thermal treatment is a heating treatment, the fluid 18 then possibly not being used.

When the thermal treatment comprises stages remote from isothermicity, it is preferable to adapt the winding diameters on the grooves of the capstans to the variations in the length of the wire 4 with its temperature, that is to say the diameter of winding De of the wire upon entering a capstan 2, 3 is different from the diameter of winding Ds of the wire at the outlet from said capstan, De and Ds corresponding therefore to two extreme grooves of this capstan. By way of example, FIG. 5 shows an arrangement corresponding to cooling of the wire 4 upon its passage over the capstan 2, the diameter De being greater than the diameter Ds. In the case of heating, the arrangement would be the opposite, with, in this case, $De < Ds$. In order to facilitate the heat exchanges, the distance E between the axes xx' and yy' of the capstans 2, 3 is as small as possible, taking into account the space taken up by these capstans and avoiding contacts between the various portion of the wire 4 between these capstans 2, 3.

The capstans 2, 3 and the plate 15 which are heat-conductive are made, for instance, of bronze, steel or cast iron.

Figure 7:
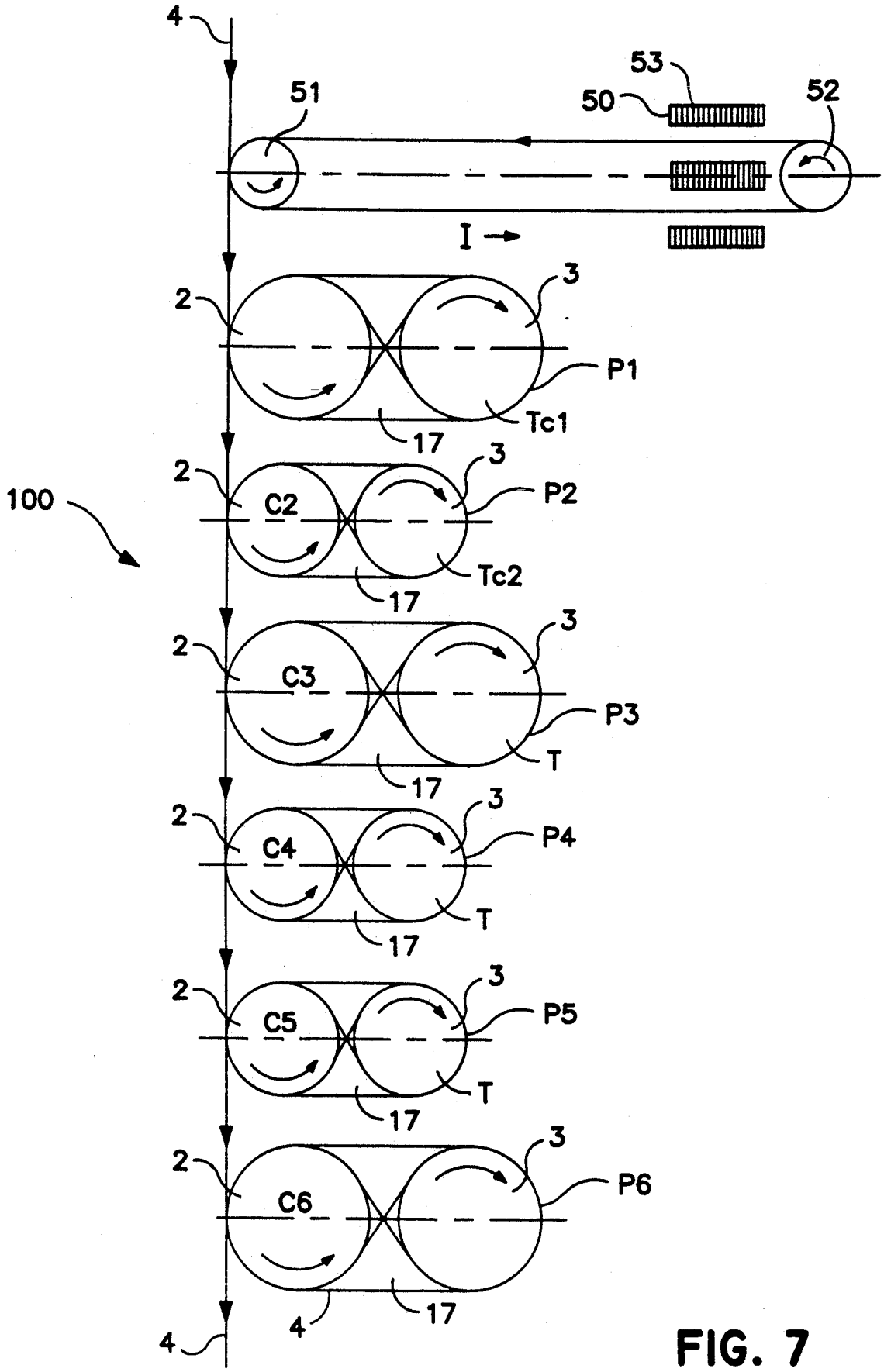
FIG. 7 shows a complete installation comprising six devices in accordance with the invention, this installation making it possible to effect a perlitization treatment.

FIG. 7 shows a complete installation 100 in accordance with the invention which permits the thermal treatment of a wire 4 of steel so as to subject it to an austenitization treatment followed by a perlitization treatment.

This complete installation 100 has one device 50 and six pairs of capstans marked P1 to P6 which are identical to the device 1 in accordance with the invention which has been previously described. The devices P1 to P6 in accordance with the invention make it possible to cool the wire 4 or to maintain it at practically constant temperature, the heat-exchange fluid 18 being, for instance, water. For simplicity in the drawing, only the capstans of the pairs P1 to P 6 and the wire 4 to be treated have been shown in this FIG. 7.

Figure 8:
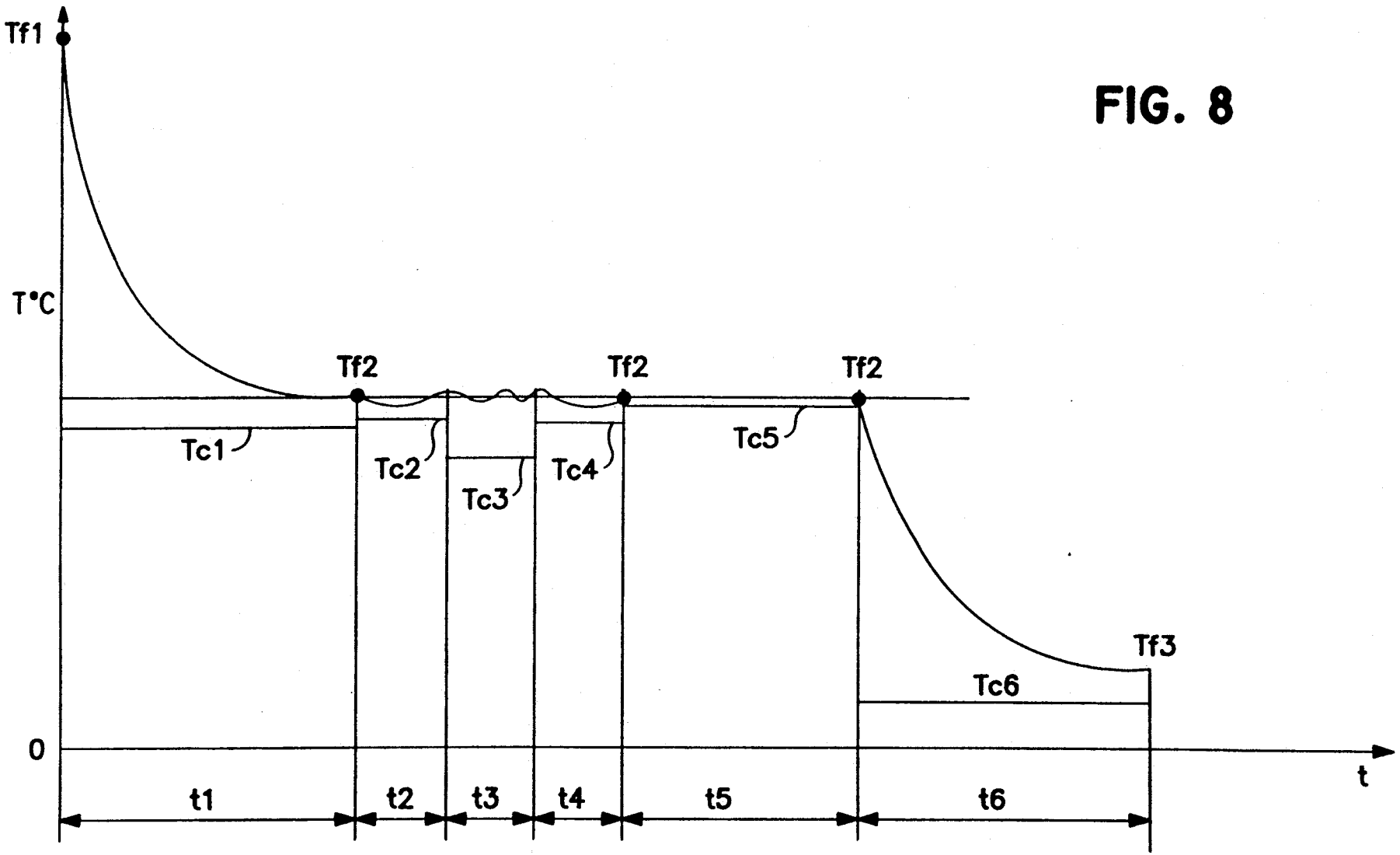
FIG. 8 shows the development, as a function of time, of the temperature of the wire and of the capstans in the installation shown in FIG. 7.

FIG. 8 shows the change of the temperature of the wire 4 and of the capstans 2, 3 upon a thermal perlitization treatment, the wire 4 being of steel, the temperature T corresponding to the ordinate axis, and the time "t" to the abscissa axis. The wire 4 enters the device 50 where it undergoes an austenitization treatment. This device 50 has two capstans 51, 52 on which the wire 4 is reeved and an alternating magnetic flux is passed into the wire loops 4 which are thus formed, this flux being produced by the inductor 53. In this way, an induced electric current is produced in the wire 4, which makes it possible to heat this wire to a temperature above the AC3 transformation temperature so as to obtain a homogeneous austenite structure, the temperature Tf1 reached by the wire 4 in the device 50 being, for instance, on the order of 900° to 1000° C.

The wire 4 which leaves the installation 50 then arrives on the capstan 2 of the capstan pair P1. The capstans 2, 3 of the pair P1 are maintained at a temperature Tc1 on the order of 450° to 650° C. In FIG. 8, the point of origin O of the time corresponds to the arrival of the wire 4 on the pair P1. At the end of a time t1 which is less than 4 seconds, the wire 4 reaches a temperature Tf2 close to that of the capstans of the pair P1. This rapid cooling therefore permits the transformation of stable austenite into meta-stable austenite. The wire 4 then passes in succession over the four pairs P2 to P5, the role of which is to maintain the wire 4 at a temperature which does not change by more than 10° C. above or below the given temperature Tf2, the temperature Tf of the wire 4 being then, for instance, within the range Tf2 −8° C. and Tf2 +8° C., and this for the entire duration of the transformation of the metastable austenite into perlite and for about 1 to 3 seconds after this transformation. The purpose of this part of the installation is, on the one hand, to avoid recalescence during the period in which the peak thermal power occurs due to the transformation of austenite into perlite (which would lead to the formation of coarse perlite) and, on the other hand, to avoid premature cooling before the transformation is complete. Premature cooling before the transformation is complete would entail the danger of leading to a product containing bainite and, therefore, to a fragile wire of poor value in use, particularly with regard to fatigue.

The time of passage of the wire 4 in the pairs P2 to P5 are marked t2 to t5 respectively, and the temperatures of the capstans of the pairs P2 to P5 are marked Tc2 to Tc5 respectively. The sum t2+t3+t4+t5 is, for instance, on the order of 4 to 10 seconds. For the four pairs P2 to P5, the diameters of the winding of the wire 4 on each capstan do not change between the entrance and the outlet, that is to say, at all times De=Ds.

Figure 9:
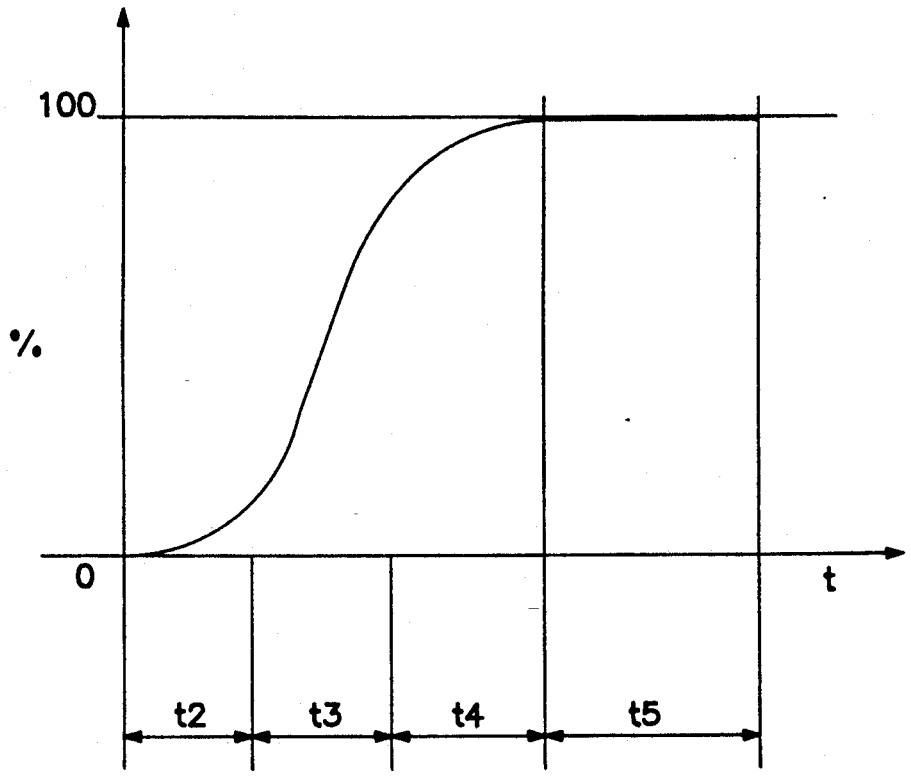
FIG. 9 shows the development of the transformation from austenite into perlite with respect to time upon the treatment of the wire in the installation shown in FIG. 7.

FIG. 9 shows the course of the transformation of austenite into perlite as a function of time. The time "t" corresponds to the abscissa axis and the percent of transformation into perlite corresponds to the ordinate axis. The transformation during the time t2 is slow, the perlitization commencing only towards the end of this time t2, and the power to be exchanged is therefore slight, and the temperature Tc2 of the second pair P2 is slightly less than the temperature desired for the transformation (Tf2). The transformation during the time t3 is very fast, and the power to be exchanged is therefore greater, and the temperature Tc3 of the third pair P3 is substantially lower than the temperature Tc2 of the second pair P2. The transformation during the time t4 takes place at a rate substantially identical to that of the time t2; the temperature Tc4 of the fourth pair P4 is therefore very close to Tc2. During the time t5, there is no substantial metallurgical transformation from a thermal standpoint, the temperature Tc5 of the fifth pair P5 being therefore substantially equal to Tf2. The purpose of this maintenance of temperature during the time t5 is to see to it that the transformation into perlite is actually complete before the cooling corresponding to the time t6.

Preferably, upon the initial cooling corresponding to the time t1, one has the following relationships:

$$K1 \geqq 0.3 \quad (1)$$

$$K2 \geqq 0.85 \quad (2)$$

$$0.5 \leqq K3 \leqq 1.5 \quad (3)$$

$$2\times10^{-4} \leqq K4 \leqq 6\times10^{-4} \quad (4)$$

with, by definition:

$$K1 = L1/(J\times Df - Df^2) \quad (5)$$

$$K2 = De/E \quad (6)$$

$$K3 = 100(De/Ds - 1) \quad (7)$$

$$K4 = (V\times Df^2\times H)/(L2\times De^2) \quad (8)$$

in which L1 is the thermal conductivity of the gas present in the grooves 11 in contact with the wire 4 and of the capstans 2, 3, L2 is the thermal conductivity of the gas constituting the layer 28 of gas 27, these conductivities L1 and L2 being determined at 600° C. and expressed in watts.m$^{-1}$. K$^{-1}$. When using the same gas 27 in the grooves 11 and the layer 28, L1 and L2 are identical and represented by L; Df is the diameter of the wire expressed in millimeters; J is the width of the grooves 11 expressed in millimeters; E is the distance from center to center of the capstans, expressed in millimeters; De is the diameter of winding of the wire 4 upon the entrance to any capstan 2, 3; Ds is the diameter of winding of the wire 4 at the outlet from the same capstan, De and Ds being expressed in millimeters; V is the speed of passage of the wire, expressed in meters per second; H is the thickness of the layer 28 of gas 27, expressed in millimeters.

Preferably, in at least one of the pairs P2 to P5 corresponding to the practically isothermal phase, the following relationships are present:

$$K2 \geqq 0.85 \quad (9)$$

$$K3 = 0 \quad (10)$$

The following relationships are furthermore advantageously verified in at least one of the pairs P2 to P4:

$$K1 \geqq 0.3 \quad (11)$$

$$0.5\times10^{-3} \leqq K4 \leqq 9\times10^{-3} \quad (12).$$

Relationships (1) to (12) are present in the event that the gas 27 in the enclosure 26, and therefore in the layer 28, suffers practically no movements other than those which are due to the rotation of the capstans 2, 3.

The isothermal character obtained during the phases t2 to t5 can only be improved if the number of elements used is greater than 4, but this leads to a greater investment, which is not necessary in order to obtain a temperature constant to ±8° C. and, on the other hand, the announced quality of the wire.

The final cooling section permits the cooling of the wire from a temperature Tf2 on the order of 450° to 650° C. to a temperature Tf3 on the order of 100° to 200° C. within a time t6 on the order of 3 to 6 seconds; it comprises a pair of reeved, crossed capstans, the lower capstan 2 being driven while the upper capstan 3 is not. The winding diameter De on the first groove of the lower capstan is greater than the diameter Ds of the last groove of the lower capstan; the capstans are maintained at a temperature Tc6 on the order of 50° to 150° C.

The examples which follow were carried out with the installation 100 previously described, using a single gas 27 for each pair P1 to P6. We therefore have L1=L2=L. As previously indicated, for each pair of capstans the gas 27 in the enclosure 26, and therefore in the layer 28, suffers practically no movements other than those which ar due to the rotation of the capstans 2, 3.

The composition of the steels used is given in table 1.

TABLE 1

| Type | C | Mn | Si | S | P | Al | Ca | Cr | Ni |
|---|---|---|---|---|---|---|---|---|---|
| 1 | 0.70 | 0.61 | 0.22 | 0.028 | 0.018 | 0.084 | 0.048 | 0.061 | 0.016 |
| 2 | 0.82 | 0.69 | 0.20 | 0.026 | 0.019 | 0.082 | 0.043 | 0.058 | 0.015 |

(The figures correspond to wt. %)

The capstans 2, 3 of the assembly of pairs P1 to P6 were made of refractory steel X 12 Cr Ni 25 21 (THERMAX 4845 of Thyssen), Cr=25% Ni=20%. The properties of this steel are:

thermal conductivity at 500° C.: 19 $w.m^{-1}.K^{-1}$ thermal expansion at 400° C.: $17.10^{-6} m.m^{-1}.K^{-1}$ The cover rate Tr is the ratio between the length of wire in contact with the groove bottoms and the total length of wire contained between the first point of contact upon arrival onto the thermal transfer element and the last point 10 upon departure, that is to say between the points 5 and 10 previously defined (FIG. 3).

The ratio of the cross sections is, by definition:

$$R = \frac{\text{cross section of the wire before drawing}}{\text{cross section of the wire after drawing}}$$

The rational deformation is, by definition $$\epsilon = \text{Log}(R)$$

Log designating the natural logarithm.

The incubation time is the time necessary in order for 1% metastable austenite to be transformed into perlite, this time being calculated as from the start of the cooling (arrival of the wire 4 on the pair P1).

The transformation time is the time necessary in order to pass from 1% to 99% perlite.

EXAMPLE 1

The test conditions are as follows:

steel type 1, incubation time=about 3 seconds, transformation time=about 3 seconds, diameter of the wire: Df=1.1 mm, velocity V of passage of the wire: 15 m/s gas 27:

For the thermal transfer elements P1 to P4: $H_2+N_2$, with 75% $H_2$ and 25% $N_2$ by volume (NH3 cracked).

For the isothermal maintaining element P5: pure $N_2$.

For the final cooling element P6: pure $H_2$.

A single gas is used for each thermal transfer element for purposes of technological simplification, that is to say L1=L2=L, but, in case of need, it is possible to use different gases for the wire 4/capstan 2 or 3 thermal coupling and for the capstan 2 or 3/cooling plate 15 thermal coupling.

Primary Cooling Period t1

| First pair of capstans P1 | |
|---|---|
| Diameter of the capstans at the entrance of the wire: | De = 1007 mm |
| Diameter of the capstans at the outlet of the wire: | Ds = 1000 mm |
| Center to center distance between capstans: | E = 1050 mm |
| Cover rate of the capstans: | Tr = 0.902 |
| Pitch of the grooves: | p = 10 mm |

-continued

| First pair of capstans P1 | |
|---|---|
| Width of the grooves: | J = 1.7 mm |
| Speed of rotation of the capstan 2: | 287 rpm |
| Dwell time: | t1 = 2.94 seconds |
| Number of turns: | 7 |
| Initial temperature of the wire: | Tf1 = 930° C. |
| Final temperature of the wire: | Tf2 = 580° C. |

The capstans were maintained at a temperature of 520° C. by means of a flow of water at 25° C. of 2.4 $m^3$/hr.

Thickness of the layer 28 of thermal coupling gas 27: H=7.8 mm.

Main parameters of the thermal transfer element:

K1=0.424

K2=0.959

K3=0.7

K4=$4.99\times10^{-4}$

Isothermal Holding Periods t2, t3, t4, t5

| Second pair P2 of capstans, period t2 | |
|---|---|
| Diameter of the capstans at the entrance of the wire: | De = 1000 mm |
| Diameter of the capstans at the outlet of the wire: | Ds = 1000 mm |
| Center to center distance between capstans: | E = 1050 mm |
| Cover rate of the capstans: | Tr = 0.898 |
| Pitch of the grooves: | p = 10 mm |
| Width of the grooves: | J = 1.7 mm |
| Speed of rotation of the capstan 2: | 289 rpm |
| Dwell time: | t2 = 1.26 seconds |
| Number of turns: | 3 |

The temperature of the wire was maintained at 580°±5° C.

The capstans were maintained at a temperature of 545° C. by means of a flow of water at 25° C. of 0.15 $m^3$/hr.

Thickness of the layer of thermal coupling gas: H=100 mm.

Main parameters of the thermal transfer element:

K1=0.424

K2=0.952

K3=0

K4=$6.4\times10^{-3}$

Third pair P3 of capstans, period t3

| | |
|---|---|
| Diameter of the capstans at the entrance of the wire: | De = 1000 mm |
| Diameter of the capstans at the outlet of the wire: | Ds = 1000 mm |
| Center to center distance between capstans: | E = 1050 m |
| Cover rate of the capstans Tr: | 0.898 |
| Pitch of the grooves: | p = 10 mm |
| Width of the grooves: | J = 1.7 mm |
| Speed of rotation of the capstan 2: | 289 rpm |
| Dwell time: | t3 = 1.26 seconds |
| Number of turns: | 3 |

The temperature of the wire was maintained at 580°±6° C.

The capstans were maintained at a temperature of: 417° C. by means of a flow of water at 25° C. of: 0.7 $m^3$/hr.

Thickness of the layer of thermal coupling gas: H=16.5 mm.

Main parameters of the thermal transfer element:

K1=0.424

K2=0.952
K3=0
K4=$1.07\times10^{-3}$

Fourth pair P4 of capstans, period t4: identical to the second pair of capstans.

| Fifth pair P5 of capstans, period t5 | |
|---|---|
| Diameter of the capstans at the entrance of the wire: | De = 600 mm |
| Diameter of the capstans at the outlet of the wire: | Ds = 600 mm |
| Center to center distance between capstans: | E = 630 mm |
| Cover rate of the capstans: | Tr = 0.898 |
| Pitch of the grooves | p = 10 mm |
| Width of the grooves: | J = 3 mm |
| Speed of rotation of the capstan 2: | 480 rpm |
| Dwell time: | t5 = 1.26 seconds |
| Number of turns: | 5 |

The temperature of the wire was maintained at 580°±2° C.

The capstans were maintained at a temperature of: 585°±5° C. by means of electric resistors 38; the circulation of water was cut off.

The thickness H of the layer of thermal coupling gas was maintained at the maximum in order to limit the consumption of electricity, namely: H=50 mm.

Main parameters of the thermal transfer element:
K1=$2.392\times10^{-2}$
K2=0.952
K3=0
K4=$5.0\times10^{-2}$ Final Cooling Period t6

| Sixth pair P6 of capstans | |
|---|---|
| Diameter of the capstans at the entrance of the wire: | De = 1000 mm |
| Diameter of the capstans at the outlet of the wire: | Ds = 993 mm |
| Center to center distance between capstans: | E = 1050 mm |
| Cover rate of the capstans: | Tr = 0.894 |
| Pitch of the grooves: | p = 10 mm |
| Width of the grooves: | J = 1.7 mm |
| Speed of rotation of the capstan 2: | 287 rpm |
| Dwell time: | t6 = 4.19 seconds |
| Number of turns: | 10 |
| Initial temperature of the wire: | Tf2 = 580° C. |
| Final temperature of the wire: | Tf3 = 193° C. |

The capstans were maintained at a temperature of: 170° C. by means of a flow of water at 25° C. of: 2.13 $m^3$/hr.

Thickness of the layer of thermal coupling gas: H=1.5 mm.

Main parameters of the thermal transfer element:
K1=0.424
K2=0.952
K3=0.7
K4=$9.08\times10^{-5}$ After thermal treatment, the wire 4 has a resistance to rupture in traction of 1200 MPa (megapascals).

This wire was then brass-coated and then drawn in known manner to obtain a final diameter of 0.17 mm. The resistance to rupture in traction for this drawn wire is 3000 MPa.

$R=41.87$ $\epsilon=3.73$

EXAMPLE 2

This example is identical to the preceding one, except for the fact that a type 2 steel is used instead of a type 1 steel. The incubation time and the transformation time are substantially the same as in the preceding example.

After thermal treatment, the wire has a resistance to rupture in traction of 1350 MPa.

This wire was then brass-coated and drawn in known manner to obtain a final diameter of 0.17 mm. The resistance to rupture in traction for this drawn wire is 3500 MPa.

$R=41.87$ $\epsilon=3.73$

EXAMPLE 3

The conditions of this test are as follows:
Steel type 1
Incubation time=about 3 seconds
Transformation time=about 3 seconds
Diameter of the wire: Df=1.83 mm
Velocity V of passage of the wire: 15 m/s
Gas 27:
For the thermal transfer elements P1 to P4: pure $H_2$.
For the isothermal maintaining element P5: pure $N_2$.
For the final cooling element P6: pure $H_2$.

Primary Cooling Period t1

| First pair P1 of capstans | |
|---|---|
| Diameter of the capstans at the entrance of the wire: | De = 1510 mm |
| Diameter of the capstans at the outlet of the wire: | Ds = 1500 mm |
| Center to center distance between capstans: | E = 1575 mm |
| Cover rate of the capstans: | Tr = 0.902 |
| Pitch of the grooves: | p = 11 mm |
| Width of the grooves: | J = 2.3 mm |
| Speed of rotation of the capstan 2: | 191 rpm |
| Dwell time: | t1 = 3.16 seconds |
| Number of turns: | 5 |
| Initial temperature of the wire: | Tf1 = 930° C. |
| Final temperature of the wire: | Tf2 = 580° C. |

The capstans were maintained at a temperature of: 450° C. by means of a flow of water at 25° C. of: 7.16 $m^3$/hr.

Thickness of the layer of thermal coupling gas: H=7 mm.

Main parameters of the thermal transfer element:
K1=0.488
K2=0.959
K3=0.67
K4=$3.67\times10^{-4}$ Isothermal Maintenance Periods t2, t3, t4, t5

| Second pair P2 of capstans period t2 | |
|---|---|
| Diameter of the capstans at the entrance of the wire: | De = 1500 mm |
| Diameter of the capstans at the outlet of the wire: | Ds = 1500 mm |
| Center to center distance between capstans: | E = 1575 mm |
| Cover rate of the capstans: | Tr = 0.898 |
| Pitch of the grooves: | p = 11 mm |
| Width of the grooves: | J = 2.3 mm |
| Speed of rotation of the capstan 2: | 192 rpm |
| Dwell time: | t2 = 1.26 seconds |

-continued

| Second pair P2 of capstans period t2 | |
|---|---|
| Number of turns: | 2 |

The temperature of the wire was maintained at 580°±5° C.

The capstans were maintained at a temperature of 549° C. by means of a flow of water of 25° C. of: 0.4 $m^3$/hr.

The thickness of the layer of thermal coupling gas: H=123 mm.

Main parameters of the thermal transfer element:

K1=0.488
K2=0.952
K3=0
K4=$6.54\times10^{-3}$

| Third pair P3 of capstans period t3 | |
|---|---|
| Diameter of the capstans at the entrance of the wire: | De = 1500 mm |
| Diameter of the capstans at the outlet of the wire: | Ds = 1500 mm |
| Center to center distance between capstans: | E = 1575 mm |
| Cover rate of the capstans: | Tr = 0.898 |
| Pitch of the grooves: | p = 11 mm |
| Width of the grooves: | J = 2.3 m |
| Speed of rotation of the capstan 2: | 192 rpm |
| Dwell time: | t3 = 1.26 seconds |
| Number of turns: | 2 |

The temperature of the wire was maintained at 580°±6° C.

The capstans were maintained at a temperature of 436° C. by means of a flow of water of 25° C. of: 1.85 $m^3$/hr.

The thickness of the layer of thermal coupling gas: H=20 mm.

Main parameters of the thermal transfer element:

K1=0.488
K2=0.952
K3=0
K4=$1.06\times10^{-3}$

Fourth pair P4 of capstans period t4 Identical to the second pair of capstans

| Fifth pair P5 of capstans period t5 | |
|---|---|
| Diameter of the capstans at the entrance of the wire: | De = 900 mm |
| Diameterx of the capstans at the outlet of the wire: | Ds = 900 mm |
| Center to center distance between capstans: | E = 945 mm |
| Cover rate of the capstans: | Tr = 0.898 |
| Pitch of the grooves: | p = 11 mm |
| Width of the grooves: | J = 3 mm |
| Speed of rotation of the capstan 2: | 320 rpm |
| Dwell time: | t5 = 1.51 seconds |
| Number of turns: | 4 |

The temperature of the wire was maintained at 580°±2° C.

The capstans were maintained at a temperature of 585°±5° C. by electric resistors 38; the circulation of water was cut off.

The thickness H of the layer of thermal coupling gas was maintained at the maximum in order to limit the consumption of electricity, namely: H=50 mm.

Main parameters of the thermal transfer element:

K1=0.0233
K2=0.952
K3=0
K4=0.062

Final Cooling Period t6

| Sixth pair P6 of capstans | |
|---|---|
| Diameter of the capstans at the entrance of the wire: | De = 1500 mm |
| Diameter of the capstans at the outlet of the wire: | Ds = 1489 mm |
| Center to center distance between capstans: | E = 1575 mm |
| Cover rate of the capstans: | Tr = 0.894 |
| Pitch of the grooves: | p = 11 mm |
| Width of the grooves: | J = 2.3 mm |
| Speed of rotation of the capstan 2: | 192 rpm |
| Dwell time: | t6 = 4.4 seconds |
| Number of turns: | 7 |
| Initial temerpature of the wire: | Tf2 = 580° C. |
| Final temperature of the wire: | Tf3 = 211° C. |

The capstans were maintained at a temperature of: 170° C. by means of a flow of water at 25° C. of: 5.88 $m^3$/hr.

Thickness of the layer of thermal coupling gas: H=1.7 mm.

Main parameters of the thermal transfer element:

K1=0.488
K2=0.952
K3=0.74
K4=$9.04\times10^{-5}$

After thermal treatment, the wire 4 has a resistance to rupture in traction of 1200 MPa.

This wire was then brass-coated and then drawn in known manner in order to obtain a final diameter of 0.28 mm. The resistance to rupture in traction for this drawn wire is 3050 MPa.

$R=42.72$ $\epsilon=3.75$

EXAMPLE 4

This example is identical to the previous one, except for the fact that a type 2 steel was used instead of a type 1 steel. The incubation time and the transformation time are substantially the same as in the preceding example.

After thermal treatment, the wire has a resistance to rupture in traction of 1345 MPa.

The wire was then brass-coated and then drawn in known manner to obtain a final diameter of 0.28 mm. The resistance to rupture in traction for this drawn wire is 3480 MPa.

$R=42.72$ $\epsilon=3.75$

EXAMPLE 5

The conditions of this example are the following:

Steel type 1
Incubation time=about 3.5 seconds
Transformation time=about 3 seconds
Diameter of the wire: Df=2.35 mm
Velocity V of passage of the wire: 15 m/s
Gas 27:
For thermal transfer elements 1 to 4 and 6: pure $H_2$,
For the isothermal maintaining element 5: pure $N_2$, A single gas is used for each thermal transfer element, for purposes of technological simplification.

Primary Cooling Period t1

| First pair P1 of capstans | |
|---|---|
| Diameter of the capstans at the entrance of the wire: | De = 2114 mm |
| Diameter of the capstans at the outlet of the wire: | Ds = 2100 mm |
| Center to center distance between capstans: | E = 2210 mm |
| Cover rate of the capstans: | Tr = 0.8996 |
| Pitch of the grooves: | p = 12 mm |
| Width of the grooves: | J = 2.7 mm |
| Speed of rotation of the capstan 2: | 136 rpm |
| Dwell time: | t1 = 3.54 seconds |
| Number of turns: | 4 |
| Initial temperature of the wire: | Tf1 = 930° C. |
| Final temperature of the wire: | Tf2 = 580° C. |

The capstans were maintained at a temperature of: 558° C. by means of a flow of water of 25° C. of: 9.95 $m^3$/hr.

Thickness of the layer of thermal coupling gas: H=10 mm.

Main parameters of the thermal transfer element:

K1=0.51

K2=0.957

K3=0.667

K4=$4.44\times10^{-4}$

Isothermal Maintenance Periods t2, t3, t4, t5

| Second pair P2 of capstans period t2 | |
|---|---|
| Diameter of the capstans at the entrance of the wire: | De = 2100 mm |
| Diameter of the capstans at the outlet of the wire: | Ds = 2100 mm |
| Center to center distance between capstans: | E = 2210 mm |
| Cover rate of the capstans: | Tr = 0.896 |
| Pitch of the grooves: | p = 12 mm |
| Width of the grooves: | J = 2.7 mm |
| Speed of rotation of the capstan 2: | 137 rpm |
| Dwell time: | t2 = 1.77 seconds |
| Number of turns: | 2 |

The temperature of the wire was maintained at 580°±5° C.

The capstans were maintained at a temperature of: 550° C. by means of a flow of water of 25° C. of: 0.66 $m^3$/hr.

The thickness of the layer of thermal coupling gas: H=147 mm.

Main parameters of the thermal transfer element:

K1=0.51

K2=0.95

K3=0

K4=$6.57\times10^{-3}$

| Third pair P3 of capstans period t3 | |
|---|---|
| Diameter of the capstans at the entrance of the wire: | De = 2100 mm |
| Diameter of the capstans at the outlet of the wire: | Ds = 2100 mm |
| Center to center distance between capstans: | E = 2210 mm |
| Cover rate of the capstans: | Tr = 0.896 |
| Pitch of the grooves: | p = 12 mm |
| Width of the grooves: | J = 2.7 mm |
| Speed of rotation of the capstan 2: | 137 rpm |
| Dwell time: | t3 = 1.77 seconds |

-continued

| Third pair P3 of capstans period t3 | |
|---|---|
| Number of turns: | 2 |

The temperature of the wire was maintained at 580°±6° C.

The capstans were maintained at a temperature of: 443° C. by means of a flow of water of 25° C. of: 3 $m^3$/hr.

Thickness of the layer of thermal coupling gas: H=25 mm.

Main parameters of the thermal transfer element:

K1=0.51

K2=0.95

K3=0

K4=$1.12\times10^{-3}$

Fourth pair P4 of capstans period t4 Identical to the second pair P2 of capstans

| Fifth pair P5 of capstans period t5 | |
|---|---|
| Diameter of the capstans at the entrance of the Wire: | De = 1200 mm |
| Diameter of the capstans at the outlet of the wire: | Ds = 1200 mm |
| Center to center distance between capstans: | E = 1260 mm |
| Cover rate of the capstans: | Tr = 0.898 |
| Pitch of the grooves: | p = 12 mm |
| Width of the grooves: | J = 4.5 mm |
| Speed of rotation of the capstan 2: | 239 rpm |
| Dwell time: | t5 = 2 seconds |
| Number of turns: | 4 |

The temperature of the wire was maintained at 580°±2° C.

The capstans were maintained at a temperature of: 585°±5° C. by means of the electrical resistors 38; the circulation of water was cut off.

The thickness H of the layer of thermal coupling gas was maintained at the maximum in order to limit the consumption of electricity, namely: H=100 mm.

Main parameters of the thermal transfer element:

K1=0.01

K2=0.952

K3=0

K4=0.115

Final Cooling Period t6

| Sixth pair P6 of capstans | |
|---|---|
| Diameter of the capstans at the entrance of the wire: | De = 2100 mm |
| Diameter of the capstans at the outlet of the wire: | Ds = 2085 mm |
| Center to center distance between capstans: | E = 2210 mm |
| Cover rate of the capstans: | Tr = 0.8645 |
| Pitch of the grooves: | p = 12 mm |
| Width of the grooves: | J = 2.7 mm |
| Speed of rotation of the capstan 2: | 137 rpm |
| Dwell time: | t6 = 5.28 seconds |
| Number of turns: | 6 |
| Initial temperature of the wire: | Tf2 = 580° C. |
| Final temperature of the wire: | Tf3 = 204° C. |

The capstans were maintained at a temperature of: 170° C. by means of a flow of water of 25° C. of: 9.5 $m^3$/hr.

Thickness of the layer of thermal coupling gas: H=2.2 mm.

Main parameters of the thermal transfer element:

K1=0.511
K2=0.95
K3=0.72
K4=$9.84\times10^{-5}$

After thermal treatment, the wire 4 has a resistance to rupture in traction of 1195 MPa.

This wire was then brass-coated and then drawn in known manner to obtain a final diameter of 0.35 mm. The resistance to rupture in traction for this drawn wire is 3510 MPa.

$R=45.1$ $\epsilon=3.81$

EXAMPLE 6

This example is identical to the preceding one, except for the fact that a type 2 steel is used instead of a type 1 steel. The incubation time and the transformation time are substantially the same as in the preceding example.

After thermal treatment, the wire has a resistance to rupture in traction of 1355 MPa.

This wire was then brass-coated and then drawn in known manner to obtain a final diameter of 0.35 mm. The resistance to rupture in traction for this drawn wire is 3510 MPa.

$R=45.1$ $\epsilon=3.81$

EXAMPLE 7

This example is identical to example 1, with the exception of the use of a type 1 steel from the standpoint of composition, but with an incubation time of 3.8 seconds and a transformation time of 3.8 seconds at 580° C.

The installation is identical to that used for example 1, except for the number of turns, which is changed from 7 to 8 on the first pair P1 of capstans, and from 3 to 4 on the third pair P3 of capstans.

The resistances to rupture after thermal treatment and after drawing do not differ by more than 2% from those of example 1.

EXAMPLE 8

This example is identical to example 6, except for the use of a type 2 steel from the point of view of composition, but with an incubation time of 4.4 seconds and a transformation time of 6 seconds at 580° C.

The installation is identical to that of example 6 aside from the number of turns, which is changed from 4 to 5 on the first pair P1 of capstans, and from 2 to 3 on the third pair P3 of capstans.

The resistances to rupture after thermal treatment and after drawing do not differ by more than 2% from those of example 1.

EXAMPLE 9

This example is identical to example 2, except for the use of type 2 steel from the point of view of composition, but with an incubation time of 4 seconds and a transformation time of 3 seconds at 580° C.

In this example, the automatic regulation caused the second pair P2 of capstans to change to heating mode, that is to say, the circulation of cooling water was cut off and the electric heating resistors 38 were placed in operation so as to avoid the cooling of the wire which would have taken place on the second pair of capstans between the arrival of the wire and the time that it is the seat of the liberation of heat due to the transformation of the austenite into perlite.

The resistances to rupture after thermal treatment and after drawing decreased by less than 2% as compared with those of example 2, due to the slightly poorer thermal constancy.

The adaptability can be improved by improving the isothermal character, that is to say by increasing the number of pairs of capstans, but the small gain in resistance of the wire which can be obtained thereby generally does not justify the additional expense.

Figure 10:
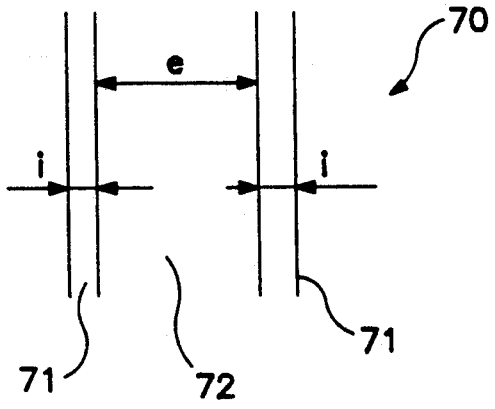
FIG. 10 shows, in section, a portion of the perlitic structure of the wire which has been treated in the installation shown in FIG. 7.

The wire 4 treated in accordance with the invention in the installation 100 has the same structure as that obtained by the known lead patenting process, that is to say a fine perlitic structure This structure has lamellae of cementite separated by lamellae of ferrite By way of example, FIG. 10 shows, in section, a portion 70 of such a fine perlitic structure This portion 70 has two cementite lamellae 71 which are practically parallel, separated by a ferrite lamella 72 The thickness of the cementite lamellae 71 is represented by "i" and the thickness of the ferrite lamellae 72 is represented by "e". The perlitic structure is fine, that is to say the average value of the sum of i+e is at most equal to 1000 Å, with a standard deviation of 250 Å.

The invention is, of course, not limited to the embodiments described above.

I claim:

1. A method for the thermal treatment of at least one metal wire by means of capstans, in which the wire is passed over at least two heat-conducting capstans having grooves, the wire being reeved, crossed in these grooves, the width of the grooves being slightly greater than that of the wire, a heat transfer gas, within the grooves, being in contact with the wire and the capstans; this method comprising:

(a) heating or cooling the capstans by means of the gas interposed between the capstans and at least one heat conductive part, this gas being in contact with the capstans and the part, this part being separated from the capstans, by causing a heat-exchange fluid other than the gas to flow in contact with the part so that heat exchanges take place, on the one hand, between the gas and the part and, on the other hand, between the part and the fluid;

(b) adjusting the thickness of the layer of the gas between the capstans and the part as a function of the thermal treatment to be carried out.

2. A method according to claim 1, wherein the layer of gas, between the capstans and the part, is located between a substantially flat face of the part and substantially flat faces of the capstans, these faces of the capstans being arranged substantially in one and the same plane which is perpendicular to the axes of rotation of the capstans and substantially parallel to the face of the part.

3. A method according to claim 1, wherein the gas arranged between the capstans and the part suffers practically no movements other than those which are due to the rotation of the capstans.

4. A method according to claim 1 for thermally treating at least one carbon steel wire so as to obtain a fine perlitic structure, this method comprising an austenitization treatment in which the wire is heated to a temperature above the AC3 transformation temperature in order to obtain a homogeneous austenite structure and a perlitization treatment in which the wire is then cooled in order to obtain a metastable austenite structure which is transformed into perlite.

5. A method according to claim 4, wherein at least one pair of capstans is used in the cooling in order to obtain a metastable austenite structure in such a manner as to have the following relationships:

$$K1 \geqq 0.3 \quad (1)$$

$$K2 \geqq 0.85 \quad (2)$$

$$0.5 \leqq K3 \leqq 1.5 \quad (3)$$

$$2\times10^{-4} \leqq K4 \leqq 6\times10^{-4} \quad (4)$$

with, by definition:

$$K1 = L/(J\times Df - Df^2) \quad (5)$$

$$K2 = De/E \quad (6)$$

$$K3 = 100\,(De/Ds - 1) \quad (7)$$

$$K4 = (V\times Df^2\times H)/(L\times De^2) \quad (8)$$

in which L is the thermal conductivity of the gas present in the grooves and between the capstans and the part, being determined at 600° C. and expressed in watts.$m^{-1}.K^{-1}$; Df is the diameter of the wire expressed in millimeters; J is the width of the grooves expressed in millimeters; E is the distance from center to center of the two capstans, expressed in millimeters; De is the diameter of winding of the wire at the entrance of any capstan; Ds is the diameter of winding of the wire at the outlet from the same capstan, De and Ds being expressed in millimeters; V is the speed of passage of the wire, expressed in meters per second; H is the thickness of the layer of gas between the capstans and the part, expressed in millimeters, this gas suffering practically no movements other than those which are due to the rotation of the capstans.

6. A method according to claim 5, using at least one pair of capstans in the transformation of austenite into perlite so that the temperature of the wire does not change by more than 10° C. plus or minus from a given temperature obtained after the cooling giving a metastable austenite structure, and this for a period of time greater than the perlitization time, the following relationships being present for at least one pair of capstans:

$$K2 \geqq 0.85 \quad (9)$$

$$K3 = 0 \quad (10)$$

the gas between the capstans and the part, in the case of this pair, suffering practically no movements other than those which are due to the rotation of the capstans.

7. A method according to claim 6, characterized by the fact that the following relationships are present for at least one pair of capstans upon the transformation of austenite into perlite:

$$K1 \geqq 0.3 \quad (11)$$

$$0.5\times10^{-3} \leqq K4 \leqq 9\times10^{-3} \quad (12)$$

the gas between the capstans and the part, in the case of this pair, suffering practically no movements other than those which are due to the rotation of the capstans.

8. A method according to claim 5, using at least one pair of capstans in order to cool the wire after the perlitization treatment.

9. A device for the thermal treatment of at least one metal wire by means of capstans, the device having at least two heat-conductive capstans which have grooves, the device furthermore comprising means making it possible to pass the wire in the grooves of the capstans, the wire being reeved, crossed in these grooves, the width of the grooves being slightly greater than that of the wire, and a heat transfer gas, within the grooves in contact with the wires and the capstans, the device further comprising:

(a) means permitting the heating or cooling of the capstans, said means comprising:
  at least one heat-conductive part separated from the capstans;
  means making it possible to cause a heat-exchange fluid other than the gas to circulate in contact with the part;
  the gas being interposed between the capstans and the part and in contact with the capstans and the part;
  these means being so arranged that thermal exchanges take place, on the one hand, between the gas and the part and, on the other hand, between the part and the fluid; and (b) means making it possible to regulate the thickness of the layer of gas between the capstans and the part as a function of the heat treatment to be carried out.

10. A device according to claim 9, wherein the layer of gas, between the capstans and the part, is located between a substantially flat face of the part and substantially flat faces of the capstans, these faces of the capstans being arranged substantially in one and the same plane which is perpendicular to the axes of rotation of the capstans and substantially parallel to the face of the part.

11. A device according to claim 9, wherein the gas arranged between the capstans and the part suffers practically no movements other than those which are due to the rotation of the capstans.

12. A device according to claim 9, wherein, for each capstan, the grooves have the axis of the capstan as their axis.

13. A device according to claim 9, wherein one of the capstans turns freely around its axis as a result of the traction of the wire and wherein the grooves of this capstan are located on heat-conductive rings, said rings being arranged on the body of the capstan and being adapted to turn around the axis of the capstan independently of the body.

14. A device according to claim 9, wherein, on at least one capstan, the winding diameter of the wire varies between the entrance and the outlet of the capstan.

15. An installation for the treatment of at least one metal wire, comprising means for heating and cooling the metal wire, said means including at least one device according to claim 9.

16. An installation according to claim 15, for the thermal treatment of at least one carbon steel wire in order to obtain a fine perlitic structure by an austenitization treatment, in which the wire is heated to a temperature above the AC3 transformation temperature in order to obtain a homogeneous austenite structure, and a perlitization treatment in which the wire is then cooled in order to obtain a metastable austenite structure which is transformed into perlite, at least one device being intended for the perlitization treatment.

17. An installation according to claim 16, wherein at least one device is intended to cool the wire in order to obtain a metastable austenite structure, this device having the following relationships:

$$K1 \geqq 0.3 \quad (1)$$

$$K2 \geqq 0.85 \quad (2)$$

$$0.5 \leqq K3 \leqq 1.5 \quad (3)$$

$$2\times10^{-4} \leqq K4 \leqq 6\times10^{-4} \quad (4)$$

with, by definition:

$$K1 = L/(J\times Df - Df^2) \quad (5)$$

$$K2 = De/E \quad (6)$$

$$K3 = 100(De/Ds - 1) \quad (7)$$

$$K4 = (V\times Df^2\times H)/(L\times De^2) \quad (8)$$

in which L is the thermal conductivity of the gas present in the grooves and between the capstans and the part, L being determined at 600° C. and expressed in watts.$m^{-1}.K^{-1}$; Df is the diameter of the wire, expressed in millimeters; J is the width of the grooves, expressed in millimeters; E is the center to center distance of the two capstans, expressed in millimeters; De is the diameter of winding of the wire at the entrance of any capstan; Ds is the diameter of winding of the wire at the outlet from the same capstan, De and Ds being expressed in millimeters; V is the speed of passage of the wire, expressed in meters per second; H is the thickness of the layer of gas between the capstans and the part, expressed in millimeters, the gas between the capstans and the part, in the case of this device, suffering practically no movements other than those which ar due to the rotation of the capstans.

18. An installation according to claim 17, wherein at least one device is intended to permit the transformation of metastable austenite into perlite, in such a manner that the temperature of the wire does not vary by more than 10° C. plus or minus from a given temperature obtained after the cooling, giving a metastable austenite structure, and this for a time greater than the perlitization time, the following relationships being present in the case of at least one device:

$$K2 \geqq 0.85 \quad (9)$$

$$K3 = 0 \quad (10)$$

the gas between the capstans and the part, in the case of this device, suffering practically no movements other than those which are due to the rotation of the capstans.

19. An installation according to claim 18, wherein at least one device intended to permit the transformation of metastable austenite into perlite has the following relationships:

$$K1 \geqq 0.3 \quad (11)$$

$$0.5\times10^{-3} \leqq K4 \leqq 9\times10^{-3} \quad (12),$$

the gas between the capstans and the part, in the case of this device, suffering practically no movements other than those which are due to the rotation of the capstans.

20. An installation according to claim 16, wherein at least one device is intended to cool the wire, after perlitization.

21. A method for the thermal treatment of at least one metal wire comprising the steps of passing the wire over at least two grooved heat-conducting capstans accommodated in a chamber containing a heat transfer gas in heat exchange relationship with the capstans and a heat conductive wall of the chamber, bringing a temperature controlling fluid other than the gas in heat exchange relation with a surface of the heat conductive wall outside the chamber, transferring heat between the wire and the temperature controlling fluid through the capstans, the heat transfer gas within the chamber and the heat conductive wall, and adjusting the thickness of the layer of the gas between the capstans and the heat conductive wall as a function of the thermal treatment to be carried out by adjusting the spacing between the capstans and the heat conductive wall.

22. An apparatus for the thermal treatment of at least one metal wire comprising at least two grooved heat-conducting capstans accommodated in a chamber containing a heat transfer gas, a heat conductive wall having one surface in communication with the heat transfer gas within the chamber and another surface in communication with a temperature controlling fluid outside the chamber, the heat transfer gas within the chamber separating the capstans and the heat conductive wall, the temperature of the wire being controlled by the transfer of heat between the wire and the temperature controlling fluid through the capstans, the heat transfer gas and the heat conductive wall, and means for adjusting the thickness of the layer of gas between the capstans and the heat conductive wall as a function of the thermal treatment to be carried out by adjusting the spacing between the capstans and the heat conductive wall.

* * * * *

UNITED STATES PATENT AND TRADEMARK OFFICE

CERTIFICATE OF CORRECTION

PATENT NO. : 5,251,881

DATED : October 12, 1993

INVENTOR(S) : Andre Reiniche

It is certified that error appears in the above-identified patent and that said Letters Patent is hereby corrected as shown below:

Title page, First Column, following Item 87, insert:

--[30] Foreign Application Priority Data
September 19, 1989 France 89 12384--;

Column 3, line 47, "capstan" should read --capstan 2--;

Column 5, last line, "o" should read --on--;

Column 9, line 1, "ar" should read --are--;

Column 9, line 21, "contact" should read --contact 5--;

Column 10, line 46, "6.4" should read --6.48--;

Column 11, line 32, "5.0" should read --5.04--;

Column 12, line 47, "450° C." should read --540° C.--;

Column 17, line 10, "3510" should read --2950--.

Signed and Sealed this

Nineteenth Day of July, 1994

Bruce Lehman

*Attest:*

BRUCE LEHMAN

*Attesting Officer*

*Commissioner of Patents and Trademarks*